US008316565B2

(12) United States Patent
Jin et al.

(10) Patent No.: US 8,316,565 B2
(45) Date of Patent: Nov. 27, 2012

(54) SOUND GENERATING PULL-OUT GREETING CARDS WITH REMOVABLE PANELS

(75) Inventors: Eva Jin, Shanghai (CN); Tiger Qiao, Shanghai (CN); Johnathan Talbot, Bay Village, OH (US); David Mayer, Bay Village, OH (US); Allison Marsh, Ravenna, OH (US)

(73) Assignee: American Greetings Corporation, Cleveland, OH (US)

( * ) Notice: Subject to any disclaimer, the term of this patent is extended or adjusted under 35 U.S.C. 154(b) by 0 days.

(21) Appl. No.: 13/176,103

(22) Filed: Jul. 5, 2011

(65) Prior Publication Data

US 2012/0000101 A1 Jan. 5, 2012

Related U.S. Application Data

(60) Provisional application No. 61/360,981, filed on Jul. 2, 2010.

(51) Int. Cl.
*G09F 1/00* (2006.01)

(52) U.S. Cl. ..... 40/124.03; 40/124.06; 40/124.11

(58) Field of Classification Search ..... 40/124.03, 40/124.06, 124.11
See application file for complete search history.

(56) References Cited

U.S. PATENT DOCUMENTS

| | | | | |
|---|---|---|---|---|
| 3,462,157 | A | 8/1969 | Barnett et al. | |
| 3,811,613 | A * | 5/1974 | Harrison | 383/20 |
| 3,946,508 | A | 3/1976 | Booras | |
| 4,611,262 | A | 9/1986 | Galloway et al. | |
| 5,652,606 | A | 7/1997 | Sasaki et al. | |
| 6,058,640 | A | 5/2000 | Young | |
| 6,061,938 | A | 5/2000 | Young | |
| 6,643,961 | B1 | 11/2003 | Hluchan | |
| 7,356,154 | B1 * | 4/2008 | Kotzin | 381/334 |
| 7,503,482 | B2 | 3/2009 | Wilen | |
| 7,603,802 | B2 | 10/2009 | Oudekerk | |
| 7,707,757 | B2 | 5/2010 | Crowell | |
| 2006/0064906 | A1 * | 3/2006 | Flemons | 40/124.06 |
| 2007/0169387 | A1 * | 7/2007 | Glass | 40/124.03 |
| 2007/0193079 | A1 * | 8/2007 | Sepesy | 40/124.06 |
| 2007/0256337 | A1 | 11/2007 | Segan | |

(Continued)

OTHER PUBLICATIONS

American Greetings, "Meowy Christmas" (greeting card), 2008, pp. 1-2, AGC, LLC, USA.

*Primary Examiner* — Gary Hoge
(74) *Attorney, Agent, or Firm* — James C. Scott; Roetzel & Andress

(57) ABSTRACT

An interactive sound generating greeting card having two separate and distinct components, one being an outer greeting card which serves as a pocket or cavity with a slot located thereon providing access to the pocket or cavity and the other being an inner greeting card which is sized to partially fit into the cavity in the outer greeting card. A sound module is contained and concealed within the outer greeting card cavity, including a switch mechanism. The inner greeting card and switch mechanism work in combination to control the play-back of a digital audio file stored on the sound module such that when the inner greeting card is contained within the cavity of the outer greeting card, playback of the digital audio file is deactivated and when the inner greeting card is removed from the cavity of the outer greeting card, playback of the digital audio file is activated.

20 Claims, 5 Drawing Sheets

U.S. PATENT DOCUMENTS

2007/0284269 A1 12/2007 Star
2009/0007469 A1 1/2009 Kamimoto
2009/0050505 A1* 2/2009 Rubin ..... 206/459.5
2009/0071046 A1* 3/2009 Hermanson et al. ..... 40/409
2009/0217559 A1* 9/2009 Sayre ..... 40/124.06
2010/0263243 A2 10/2010 Sayre

* cited by examiner

SOUND GENERATING PULL-OUT GREETING CARDS WITH REMOVABLE PANELS

RELATED APPLICATIONS

This application claims priority to U.S. Provisional Patent Application Ser. No. 61/360,981, filed on Jul. 2, 2010, which is incorporated herein by reference in its entirety.

FIELD OF THE INVENTION

The present invention is in the field of greeting cards and more specifically to musical or sound producing greeting cards having a removable or detachable portion that triggers the sound when removed or detached from the main greeting card body.

BACKGROUND OF THE INVENTION

Greeting cards are widely used for celebratory occasions such as birthdays, graduations, weddings, and for other social expression purposes. Traditional text information is generally found on paper greeting cards. Sound generating devices have been incorporated into traditional paper greeting cards to increase entertainment value and emotional impact. In some forms, a talking or musical greeting card looks just like a conventional greeting card, except that it includes a hidden sound module. Opening the greeting card will automatically turn on or close a switch so that the sound module will play the pre-stored music or dialog and closing the greeting card will automatically open the switch and stop the play of the music or dialog.

SUMMARY OF THE INVENTION

In a representative embodiment, the present disclosure and related inventions is directed to an interactive greeting card with a first greeting card having a front panel and a back panel and a cavity formed therebetween with a slot located on the front panel which provides access to the cavity, a second greeting card having a first panel and a second panel connected by a fold line, a sound module contained and concealed within the cavity of the first greeting card, the sound module operative to store and playback at least one digital audio file, a two arm contact switch contained and concealed within the cavity of the first greeting card. Insertion of the second greeting card into the slot on the first greeting card and between the two arms of the contact switch removes power from the sound module and removal of the second greeting card form the slot on the first greeting card and between the two arms of the contact switch adds power to the sound module, thereby initiating playback of the at least one digital audio file.

DETAILED DESCRIPTION OF PREFERRED AND ALTERNATE EMBODIMENTS

The greeting card of the present disclosure and related inventions combines a greeting card-within-a-greeting card or two nested greeting cards and a sound module such that when the two greeting cards are separated or when a first or inner greeting card is removed from within a second or outer greeting card, an electrical circuit is completed, triggering playback of a digital audio file which is stored within the sound module.

Figure 1:
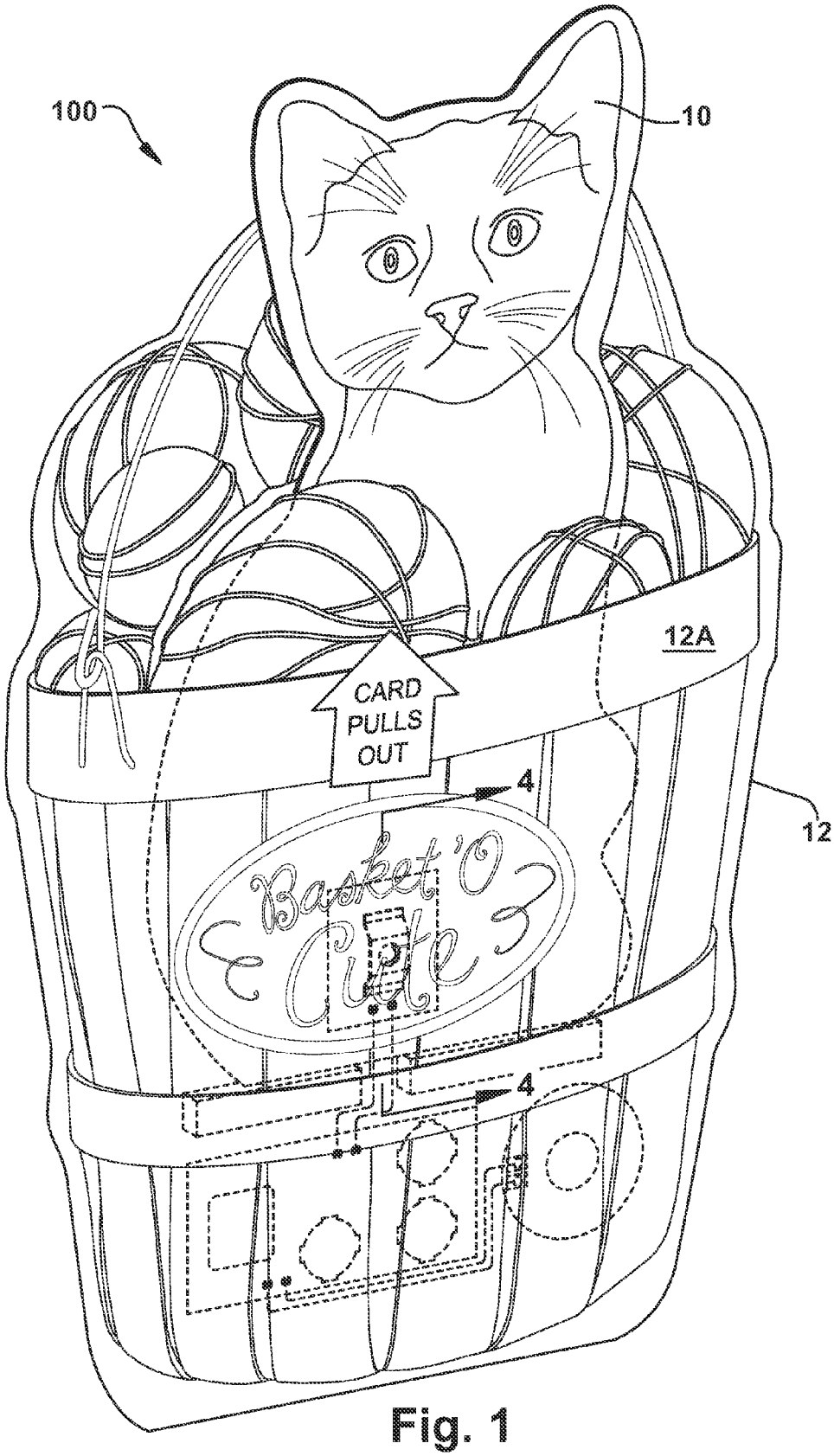
FIG. 1 is a perspective view of the greeting card of the present invention
Figure 2:
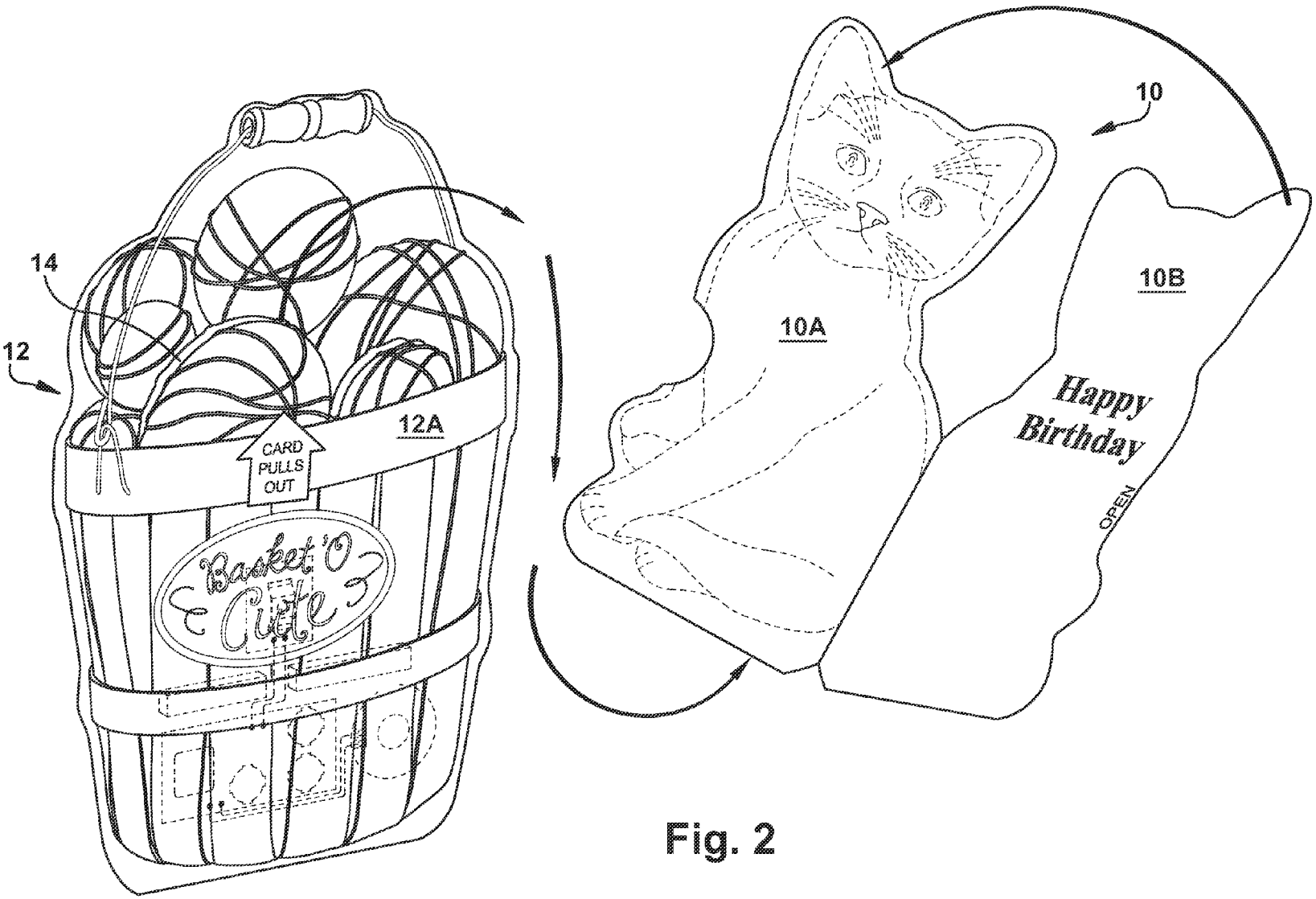
FIG. 2 is a perspective view of the greeting card of FIG. 1 with removed insert

In a preferred embodiment, shown in FIGS. 1 and 2, a first or outer greeting card 12 includes a front panel 12A and a back panel 12B which are placed in a parallel position with respect to each other and attached around the edges, using adhesive or other attachment mechanism, which creates an internal cavity therebetween. The front 12A and back panels 12B may contain straight liner edges or may contain non-linear edges. For example, the panels may be a 360-degree die shaped to resemble a person, an animal, a flower, a geometric shape, or any other conceivable shape. In addition to various die cut shapes, the panels of the outer card may be decorated with printed indicia or graphics which are printed thereon and may also contain various decorative embellishments. The front panel 12A contains a slot or aperture 14 thereon which provides access to the internal cavity between the front 12A and back 12B panels. The slot 14 may be scallop shaped or any other shape that conforms to the design of the card or the printed indicia or graphics printed thereon. Preferably, the slot or aperture 14 is located proximate to the center of the outer greeting card 12, however, the slot 14 may also be placed at any other location on the outer greeting card 12 as long as it provides enough space for the inner greeting card 10 to be at least partially inserted. The second or inner greeting card 10 is smaller in size than the first or outer greeting card 12 and is sized to fit within the slot or aperture 14 on the front panel 12A of the first or outer greeting card 12. The second or inner greeting card 10, may also be shaped with linear or non-linear edges and may be die cut to resemble a particular shape that is coordinated with the first or outer greeting card. For example, the outer greeting card 12 may resemble a basket filled with balls of yarn and the inner greeting card 10 may resemble a kitten so that when the inner greeting card 10 is placed within the cavity of the outer greeting card 12, it looks like a kitten sitting in a basket of yarn. In another example, the outer greeting card 12 may resemble a flower pot and the inner greeting card 10, a bouquet of flowers. In still another example, the outer greeting card 12 may resemble a grass hedge and the inner greeting card 10 may resemble a lawn or garden gnome. The inner greeting card 10 may also be designed with printed indicia and graphics printed thereon or contain a variety of embellishments. In a preferred embodiment, the inner greeting card 10 may be one single panel which is folded along one or more fold lines thereby creating a front panel 10A and a back panel 10B, such as in a traditional greeting card (and shown in FIG. 2), or it may be two or more separate panels which are attached together using adhesive or any other suitable attachment mechanism. A portion of the inner greeting card 10, preferably the bottom portion, fits into the slot or aperture 14 located on the front panel 12A of the first or outer greeting card 12 such that the inner card 10 is partially contained within the cavity formed between the front 12A and back 12B panels of the outer card 12. Preferably, an upper portion of the inner card 10 is visible or exposed. In a preferred embodiment, the inner card 10 may be completely removed from the outer greeting card 12. In other embodiments, the inner card 10 may be partially removed or it may have a string or other attachment which prevents complete disconnect between the outer and inner greeting cards. The inner greeting card 10 works in combination with a switch mechanism which triggers playback of a digital audio file contained within a sound module when the inner card 10 is removed from the outer card 12.

Figure 3:
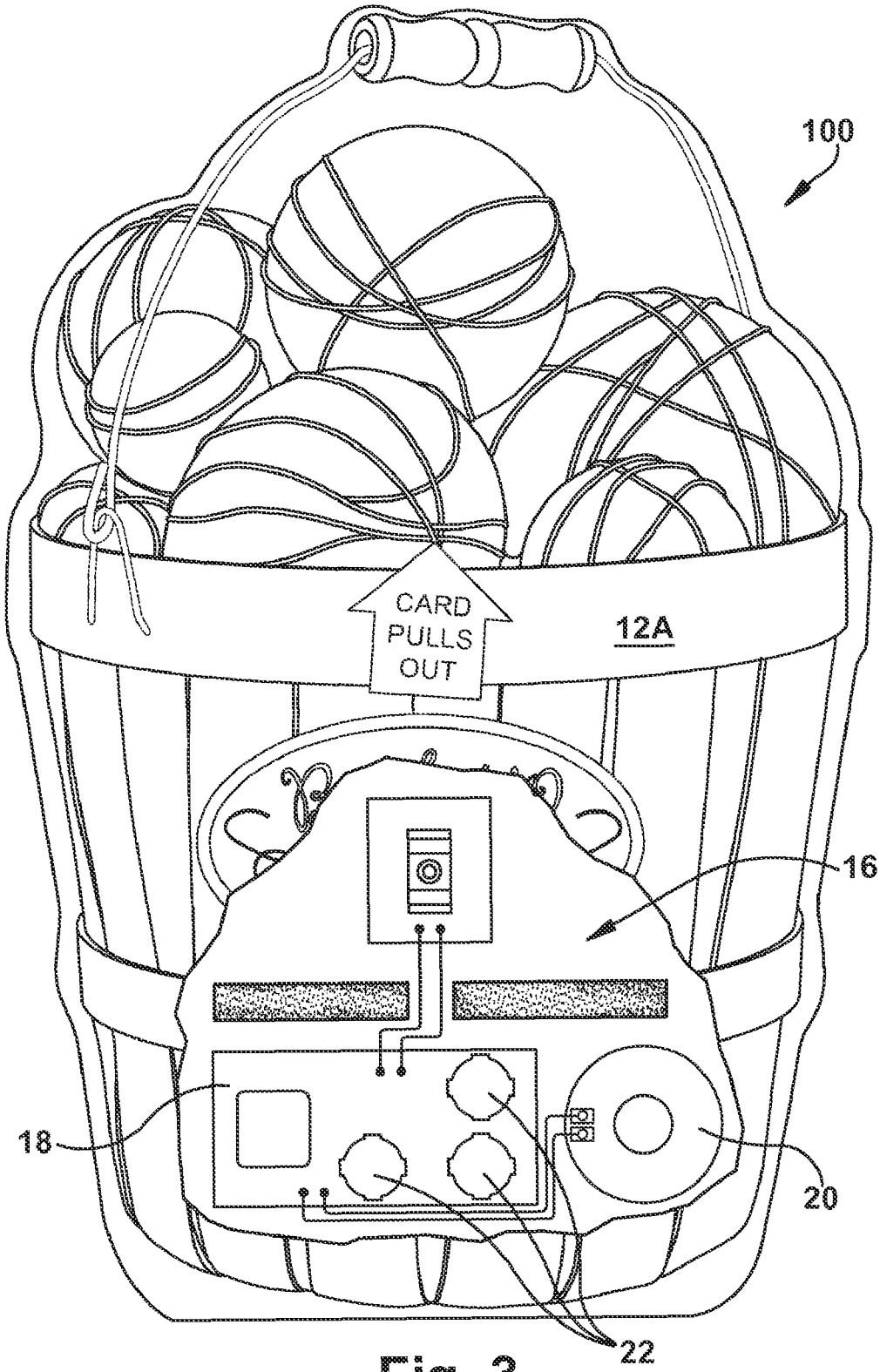
FIG. 3 is a front cut-away view of the greeting card showing the electronic components.
Figure 6:
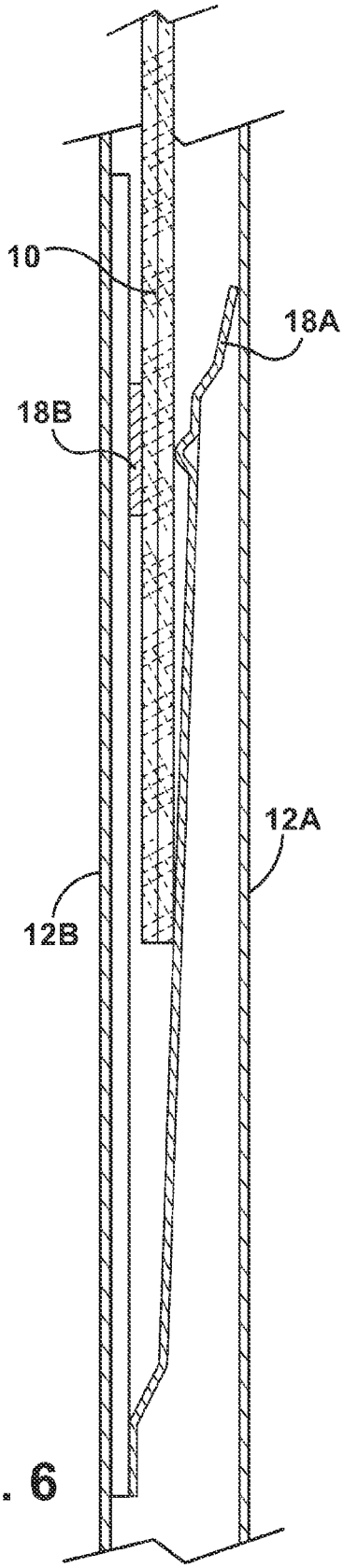
FIG. 6 is a side view of a contact switch in a first position.
Figure 7:
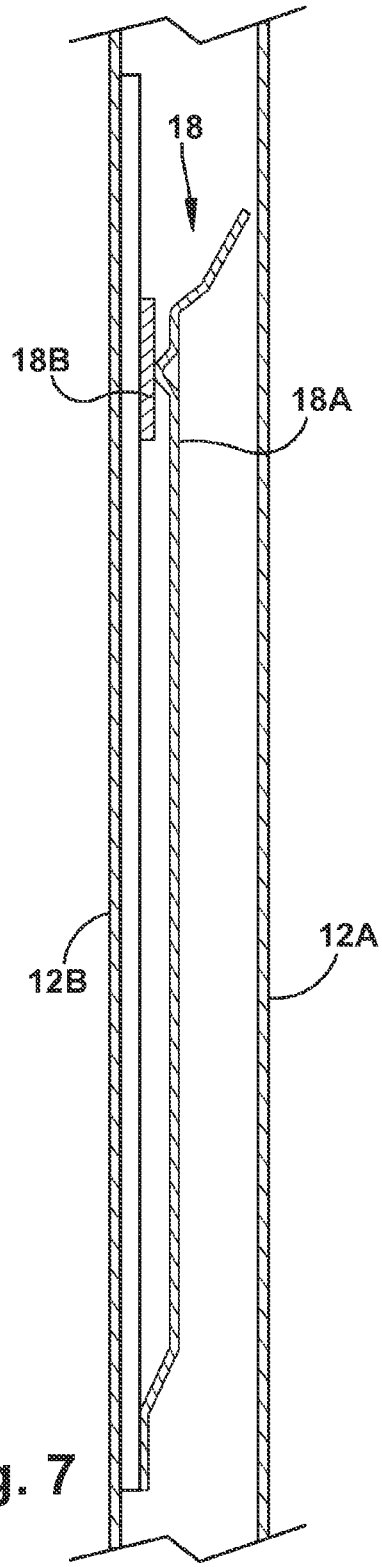
FIG. 7 is a side view of the contact switch of FIG. 7 in a second position.

The sound module 16 is contained and concealed within the front 12A and back 12B panels of the first or outer greeting card 12, as shown in FIG. 3. Components of the sound module 16 may include, but are not limited to: a printed circuit board 18 with integrated circuit chip and microprocessor, a speaker 20, a power source 22, such as one or more disposable batteries, a memory device, at least one digital sound file stored on the memory device, and a switch mechanism. Other electronic components which facilitate the storage and playback of digital audio files, as are known to one skilled in the art, may also be included. In one embodiment, shown in FIGS. 6 and 7, a contact switch 18 is used to add or remove power to the sound module 16 and thereby control playback of the digital sound file saved on the memory device. The contact switch 18 contains two contact arms 18A, 18B that when in contact complete an electrical circuit, as shown in FIG. 7. Separating the contact arms 18A, 18B breaks the circuit. As mentioned above, as the inner greeting card 10 is inserted into the slot 14 in the front panel 12A of the outer greeting card 12, it gets inserted between the two arms 18A, 18B of the contact switch 18, thereby interrupting the circuit, as shown in FIG. 6. Removal of the inner greeting card 10 from the outer greeting card 12 removes the barrier between the two contact arms 18A, 18B such that they are again in direct contact with each other (FIG. 7) thereby completing the circuit and initiating playback of at least one audio file contained on the memory device of the sound module 16. Re-inserting of the inner card 10 into the slot 16 and between the two arms 18A, 18B of the contact switch 18 deactivates the audio playback. The arms 18A, 18B of the contact switch 18 may be of any length, however, a longer length is preferred over a shorter length, to ensure proper placement of the inner greeting card 10 between the two arms 18A, 18B of the switch 18 as it is inserted into the slot 14 in the outer greeting card 12. In a preferred embodiment, the digital audio file contains audio that is consistent with or coordinated with the theme or overall spirit of the greeting card 100. For example, in the case where the outer card 12 is styled as a basket of yarn and the inner card 10 is styled as a kitten, the audio file may be the sound of a kitten meowing. In another example, where the outer card 12 is styled as a flower pot and the inner card 10 is styled as a bouquet of flowers, the audio may be instrumental music. Other examples of audio recordings include, but are not limited to a spoken message or greeting, a celebrity voice message, a song, music, a noise or other sound effect, or a combination thereof. The audio recording may be 30 seconds in length or longer and will continue to play until the circuit is interrupted by placing the inner card 10 into the slot 14 in the outer card 12 or until the maximum recording length has been reached.

Figure 4:
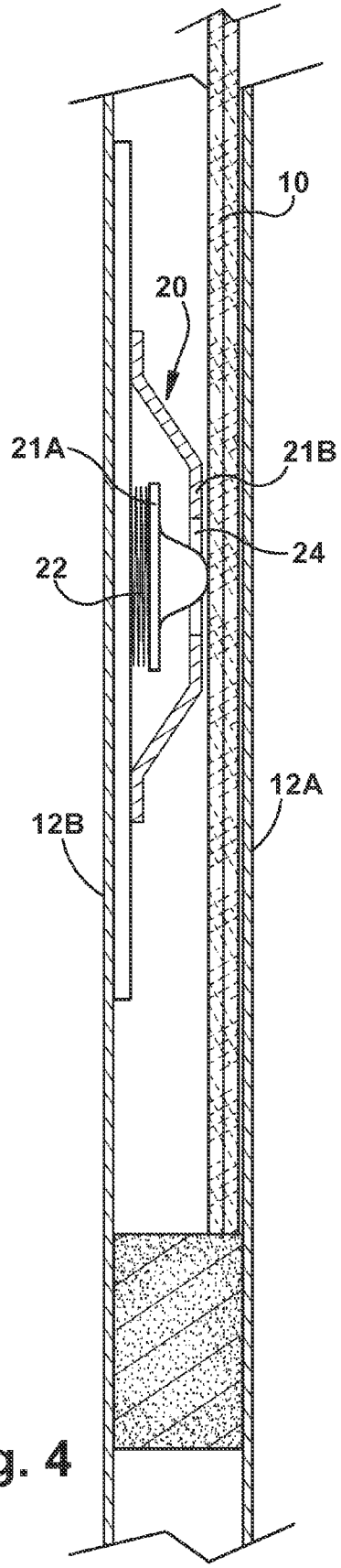
FIG. 4 is a side view of a pressure sensitive contact switch in a first position.
Figure 5:
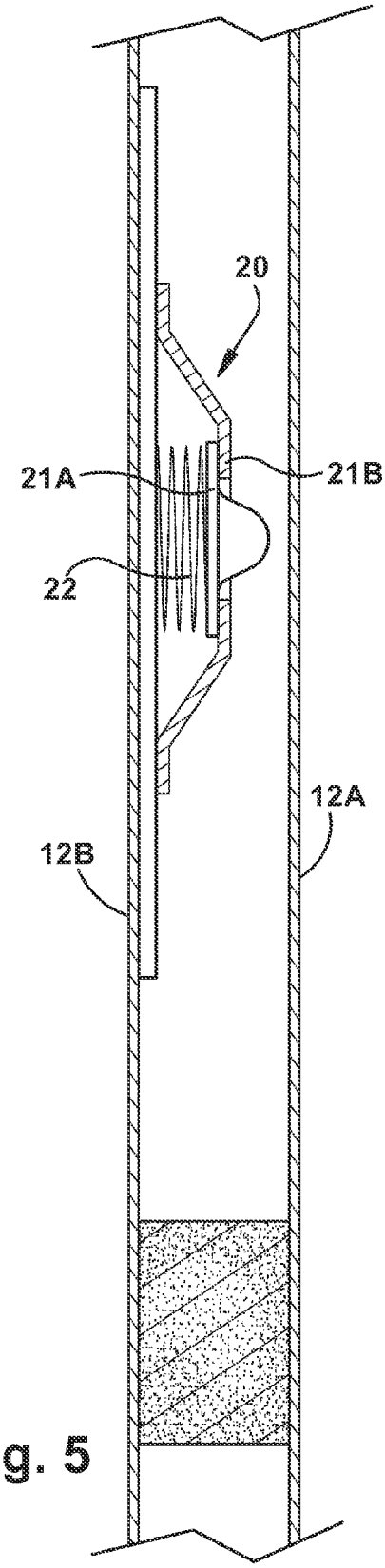
FIG. 5 is a side view of the pressure sensitive contact switch of FIG. 4 in a second position.

In another embodiment, shown in FIGS. 4 and 5, another type of contact switch 20 is used, which operates by applying or removing pressure at a certain area of the switch 20. This pressure-sensitive contact switch 20 contains two contact points 20A, 20B. A first contact point 20A is attached to a spring 22 and a second contact point 20B overlays the first contact point 20A. The second contact point 20B contains an opening 24 thereon through which the first contact point 20A protrudes. When the spring 22 of the first contact point 20A is at its fully uncompressed height, the first 20A and second 20B contact points are in contact with one another, as shown in FIG. 5, thereby completing the circuit and supplying power to the sound module 16. When the inner greeting card 10 is inserted into the slot 14 on the outer greeting card 12, the inner greeting card 10 causes the compression of the spring 22 of the first contact point 20A, as shown in FIG. 4, thereby breaking the contact between the first 20A and second 20B contact points and removing power from the sound module 16, and deactivating the pre-recorded audio.

While contact switches have been described herein and shown in the figures, they are intended as examples only and do not preclude the use of other types of switches. Other types of switch mechanisms, such as, for example, light sensitive switches and magnetic switches, have been contemplated and are considered to be within the scope of the present invention. Also, while certain die cut card shapes have been presented herein by way of example, it is in no way intended to limit the present invention to the shapes disclosed herein. Any variety of shapes and designs may be used, including card panels having linear edges.

Alternate embodiments may include such variations as having two or more slots or apertures located on the outer greeting card which accommodate two or more inner greeting cards. The sound module may be activated only upon the removal of both or all of the inner greeting cards from their corresponding slot or each inner greeting card may be configured to control separate circuits such that when a first inner card is removed from a first slot, a first pre-recorded sound clip is activated and when a second inner card is removed from a second slot, a second pre-recorded sound clip is activated, and so on. Similarly, the outer greeting card may contain only one slot which may accommodate more than one inner greeting card. A single pre-recorded audio clip may play only when both inner cards are removed from the single slot or a first pre-recorded audio clip may play when a first inner card is removed and a second pre-recorded audio clip may play when a second inner card is removed.

In other alternate embodiments, the greeting card may additionally contain a microphone and recording device so that a consumer may record a personal message to be saved on the memory device of the sound module to be played upon removal of the inner greeting card from the outer greeting card. The outer greeting card may contain a recording press-button or other suitable mechanism to initiate the recording of a personalized message. The personalized message may be played back upon removal of the inner card from the outer card and it may be preceded or followed by a pre-recorded audio clip.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive. Other features and aspects of this invention will be appreciated by those skilled in the art upon reading and comprehending this disclosure. Such features, aspects, and expected variations and modifications of the reported results and examples are clearly within the scope of the invention where the invention is limited solely by the scope of the following claims.

What is claimed is:

1. An interactive greeting card comprising:

a first greeting card having a front panel and a back panel which is opposite of and in direct contact with the front panel, the front and back panels between attached along all outer edges forming a closed cavity therebetween with a slot located on the front panel which provides access to the cavity;

a second greeting card having a first panel and a second panel connected by a fold line;

a sound module contained and concealed within the cavity of the first greeting card, the sound module operative to store and playback at least one digital audio file;

a two-arm contact switch contained and concealed within the cavity of the first greeting card;

wherein insertion of the second greeting card into the slot on the first greeting card and between the two arms of the contact switch removes power from the sound module and removal of the second greeting card from the slot on the first greeting card and between the two arms of the contact switch adds power to the sound module, thereby initiating playback of the at least one digital audio file.

2. The interactive greeting card of claim 1, wherein the second greeting card is completely detachable from the first greeting card.

3. The interactive greeting card of claim 1, wherein the first and second greeting cards are die cut.

4. The interactive greeting card of claim 1, wherein the slot of the first greeting card is located proximate to a center of the first greeting card.

5. The interactive greeting card of claim 1, wherein the first greeting card contains a first greeting printed thereon and the second greeting card contains a second greeting printed thereon.

6. The interactive greeting card of claim 1, wherein when the second greeting card is inserted into the slot on the first greeting card, a portion of the second greeting card is still visible.

7. The interactive greeting card of claim 1, wherein the edges of the first and second greeting card and the slot on the first greeting card are non-linear.

8. An interactive greeting card comprising:

a first greeting card having a first panel and a second panel in direct contact with and attached to the first panel along all outer edges, thereby creating a cavity therebetween, the first panel having an opening thereon;

a second greeting card partially contained within the cavity of the first greeting card; and a sound module comprising a circuit board, a microprocessor, a speaker, a power source, a memory device, at least one pre-recorded digital audio file saved on the memory device, and a switch;

wherein removal of the second greeting card from the cavity of the first greeting card initiates playback of the at least one pre-recorded digital audio file.

9. The interactive greeting card of claim 8, wherein the switch is a contact switch.

10. The interactive greeting card of claim 8, wherein the switch is a contact switch.

11. The interactive greeting card of claim 8, wherein the second greeting card is inserted into the first greeting card via a slot located on the first greeting card.

12. The interactive greeting card of claim 8, wherein the second greeting card contains two panels connected along a fold line.

13. The interactive greeting card of claim 8, wherein the second greeting card is a 360-degree die cut.

14. The interactive greeting card of claim 13, wherein the first greeting card is a 360-degree die cut.

15. The interactive greeting card of claim 8, wherein the second greeting card is completely detachable from the first greeting card.

16. An interactive greeting card comprising:

a nested greeting card comprising an outer greeting card having a first panel in direct contact with and attached to a second panel along all outer edges of the first and second panels and forming a cavity therebetween and an inner greeting card having a first panel and a second panel connected to a first panel along a fold line;

a slot contained on the outer greeting card sized to accommodate insertion of the inner greeting card into the cavity in the outer greeting card;

a sound module located in the cavity of the outer greeting card, the sound module operative to play pre-recorded digital audio;

a pressure sensitive contact switch having a first contact point and a second contact point, the pressure sensitive contact switch operative to control power to the sound module;

wherein placing the inner greeting card into the cavity of the outer greeting card via the slot, separates the first contact point and the second contact point of the pressure sensitive contact switch, thereby interrupting power to the sound module; and wherein removing the inner greeting card from the cavity of the outer greeting card via the slot, places the first contact point in contact with the second contact point, thereby providing power to the sound module and triggering playback of a pre-recorded digital audio file.

17. The interactive greeting card of claim 16, wherein the inner greeting card is completely detachable from the outer greeting card.

18. The interactive greeting card of claim 16, wherein the inner greeting card and the outer greeting card are both made from a 360-degree die cut.

19. The interactive greeting card of claim 16, wherein the outer greeting card contains a first greeting and the inner greeting card contains a second greeting.

20. The interactive greeting card of claim 16, wherein the inner and outer greeting cards and the digital audio file are coordinated by theme.

* * * * *